US010357065B2

(12) United States Patent
Donlon et al.

(10) Patent No.: US 10,357,065 B2
(45) Date of Patent: Jul. 23, 2019

(54) POST SURGERY BRASSIERE GARMENT

(71) Applicant: THEYA LINGERIE LTD., Dublin 2 Dublin (IE)

(72) Inventors: Ciara Donlon, Ranelagh (IE); Kelly Lakin, Leicestershire (GB)

(73) Assignee: THEYA LINGERIE LTD., Dublin (IE)

( * ) Notice: Subject to any disclaimer, the term of this patent is extended or adjusted under 35 U.S.C. 154(b) by 124 days.

(21) Appl. No.: 15/506,734

(22) PCT Filed: Aug. 29, 2015

(86) PCT No.: PCT/EP2015/069810
§ 371 (c)(1),
(2) Date: Feb. 25, 2017

(87) PCT Pub. No.: WO2016/030536
PCT Pub. Date: Mar. 3, 2016

(65) Prior Publication Data

US 2017/0265530 A1 Sep. 21, 2017

(30) Foreign Application Priority Data

Aug. 29, 2014 (IE) ..... S2014/0220

(51) Int. Cl.

| | |
|---|---|
| ***A41C 3/00*** | (2006.01) |
| ***A41C 3/02*** | (2006.01) |
| ***A41C 3/14*** | (2006.01) |
| ***A41F 15/00*** | (2006.01) |
| *A41F 1/00* | (2006.01) |

(52) U.S. Cl.
CPC ..... *A41C 3/0064* (2013.01); *A41C 3/0014* (2013.01); *A41C 3/0028* (2013.01); *A41C 3/02* (2013.01); *A41C 3/148* (2013.01); *A41F 15/002* (2013.01); *A41F 1/006* (2013.01)

(58) Field of Classification Search
CPC ... A41C 3/0064; A41C 3/0014; A41C 3/0028; A41C 3/02; A41C 3/148; A41F 15/002
USPC ..... 450/58, 54–57, 36
See application file for complete search history.

(56) References Cited

U.S. PATENT DOCUMENTS 3,215,144 A * 11/1965 Schustack ..... A41F 1/006 2/325
3,968,803 A * 7/1976 Hyman ..... A61F 13/145 602/79
5,152,741 A * 10/1992 Farnio ..... A41C 3/0064 450/1
5,538,502 A * 7/1996 Johnstone ..... A41C 3/0064 450/1

(Continued)

*Primary Examiner* — Gloria M Hale
(74) *Attorney, Agent, or Firm* — Young & Thompson

(57) ABSTRACT

A post-surgery brassiere garment for a wearer comprising a connection means comprising strap means operable to secure the brassiere garment over shoulders of the wearer, and a band region to enclose a portion of the torso of the wearer to secure the brassiere garment to the wearer; a first adjustment means operable to adjustably close the band region of the brassiere garment, and a second adjustment means operable to adjustably connect the strap means to a front region of the band region of the brassiere garment, whereby, the first and second adjustment means are together operable to adjustably compress the torso of the wearer in region of the wearers chest.

25 Claims, 10 Drawing Sheets

(56) References Cited

U.S. PATENT DOCUMENTS

| | | | | |
|---|---|---|---|---|
| 6,135,975 | A * | 10/2000 | Johnstone | A41C 3/0064 602/19 |
| 6,464,717 | B1 * | 10/2002 | Smith | A61F 7/02 450/58 |
| 6,935,921 | B1 * | 8/2005 | Eudenbach | A41C 3/0092 450/54 |
| 2009/0181599 | A1 * | 7/2009 | Farmer | A41B 17/00 450/39 |
| 2010/0130098 | A1 * | 5/2010 | Kammerer | A41C 3/02 450/39 |
| 2016/0058079 | A1 * | 3/2016 | Sexton | H05K 9/009 2/455 |

* cited by examiner

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Pre | 50 | 40 | 60 | 60 | 50 | 50 | 50 | 60 | 90 | 55 | 40 | 47 | 50 | 70 | 85 |
| Post | 70 | 45 | 65 | 80 | 55 | 59 | 70 | 90 | 90 | 75 | 64 | 85 | 80 | 80 | 98 |

POST SURGERY BRASSIERE GARMENT

The present invention relates to a post-surgery brassiere garment for use by a person after breast surgery, including a mastectomy, lumpectomy, reconstruction, augmentation and/or breast reduction surgery, or after breast cancer treatments such as radiotherapy, chemotherapy, hormone therapy, or a combination thereof.

Post-surgery brassiere garments are worn by patients following breast surgery, such as mastectomy, lumpectomy, reconstruction, augmentation and/or breast reduction surgery. Following a mastectomy or lumpectomy surgical procedure a patient typically uses a prosthetic brassiere garment which is provided with built in pockets capable of being filled with a filling material or prosthesis to simulate the appearance of one or both breasts.

However, such post-surgery brassieres suffer from many drawbacks, including that they often provide inadequate post-surgery support and are often uncomfortable and can irritate the wound areas. Moreover, as post-surgery swelling reduces, and the levels of compression required to the wound region reduce, patients are required to purchase different post-surgery brassieres to ensure appropriate compression levels are maintained throughout the healing process.

Furthermore, post-surgery brassieres are typically not aesthetically pleasing or comfortable garments to wear and are awkward to fit by a wearer as a result of post-surgery scars or difficulty moving. Additionally, and when required, appropriate positioning of a prosthesis inserted into the garment relative to the torso of a wearer is often difficult to achieve, especially since such prostheses are prone to move thereby revealing that the wearer has had mastectomy or lumpectomy surgery.

It is a therefore an object of the present invention to overcome at least one of the above-mentioned problems.

Further aspects of the present invention will become apparent form the ensuing description which is given by way of example only.

SUMMARY OF THE INVENTION

According to the invention, there is provided a post-surgery or a post breast cancer treatment brassiere garment for a wearer comprising:

- connection means comprising strap means operable to secure the brassiere garment over shoulders of the wearer, and a band region to enclose a portion of the torso of the wearer to secure the brassiere garment to the wearer;
- first adjustment means operable to adjustably close the band region of the brassiere garment, and
- second adjustment means operable to adjustably connect the strap means to a front region of the band region of the brassiere garment,
- whereby, the first and second adjustment means are together operable to adjustably compress the torso of the wearer in region of the wearers chest.

The provision of first and second adjustment means together ensure that the wound region, and in particular, swelling being experienced by the wearer, may be compressed both from the wearer's shoulders and from the chest area simultaneously to thereby provide support to the wound region post-surgery and improve healing. Moreover, providing such first and second adjustment means enables patients to adjust compression levels by themselves as needed when swelling starts to reduce and thereby avoid the previous requirement to purchase additional post-surgery garments as the healing process progresses. The present invention provides a comfortable brasserie that resembles a lingerie article and may be worn until the wearer has fully healed from surgery. The dual adjustment means also ensures that the garment may be worn by wearers of different sizes and to fit to different body types.

Preferably, the garment comprises an inner layer and an outer layer.

Preferably, the inner layer and the outer layer are connected such that the brassiere garment is unitary. Preferably, the inner layer and the outer layer are seamlessly connected.

Preferably, the garment comprises an edge trim which extends along at least of portion of the perimeter of the garment. Preferably, elastic is housed within the edge trim to avoid irritation of a wearer by skin contacting with the elastic.

In an alternative embodiment, the inner layer and/or the outer layer comprise a plurality of panels connected together to form the garment.

Preferably, at least one opening is formed between the inner and outer layer defining a receiving pocket in a front region of the garment for a prosthesis or filling material simulating a breast of the wearer.

Preferably, the first and second adjustment means are together further operable to enable a wearer to adjust the position of the receiving pocket relative to the chest of the wearer when the brassiere garment is worn. In this way the receiving pocket(s) of the garment and the inserted prosthesis or filling material may be correctly positioned and aligned and adjustably maintained adjacent to the chest as required by the wearer to simulate a natural breast of the wearer.

In another embodiment of the invention, the first adjustment means extends vertically from a top edge to a bottom edge of the front region or a back region.

Preferably, the front region comprises left and right side panels and the first adjustment means comprises a first fastening device operable to adjustably connect the left side panel to the right side panel, which when connected closes the band region of the garment.

Preferably, the back region comprises left and right side panels and the first adjustment means comprises a first fastening device operable to adjustably connect the left side panel to the right side panel, which when connected closes the band region of the garment.

In another embodiment of the invention, the first fastening device comprises a hook and eye arrangement. In such an embodiment there may be provided at least one column of hook elements on one of the left and right side panels, and spaced apart columns of eye elements on the other of the left and right side panels.

Preferably, the first adjustment means is provided adjacent the or each receiving pocket of the garment.

In an alternative embodiment, the first fastening device comprises Velcro™ arrangement or a zipper arrangement.

In another embodiment of the invention, the second adjustment means comprises a second fastening device to releasably connect the strap means to the front region of the brassiere garment.

Preferably, the second adjustment means connects the strap means to the front region of the garment adjacent to the position of a receiving pocket of the garment.

Preferably, the strap means comprises a first end connected to a back region of the garment, and a second free end adapted to be connectable to a front region of the garment, optionally adjacent a receiving pocket of the garment.

Preferably, the second free end mounts one of: a receiver and a connector of the second fastening device, and the front region mounts the other of the receiver and the connector of the second fastening device, whereby the receiver and connector are engaged to adjustably connect the strap means to the front region of the brassiere garment.

Preferably, the receiver of the second fastening means comprises a plurality of adjacent loop formations.

Preferably, the loop formations extend from a position intermediate the first end and second free end of the strap means in a sequence towards to the second free end.

Preferably, the loops are formed by a strip of material or tape connected to the outer layer.

Preferably, the loops are formed by a strip of material or tape connected to the outer layer along a face of the free end of strap means or the front region of the brassiere garment or the back region of the garment.

Preferably, the strip of material or tape is connected to the outer layer of the garment by connections such that gaps formed in between the connections provide adjacent loop formations for coupling with the connector.

Preferably, the connector of the second fastening means comprises a hook operable to connect with a loop.

In an alternative embodiment, the second fastening device comprises Velcro™ arrangement or a zipper arrangement.

The garment of the present invention further comprises gentle moulded cups within the receiving pockets on the or in between the first and second layers for insertion of prosthesis. Optionally, the garment comes with removable soft foam pads.

The garment is optionally seamless to avoid irritating scars after surgery. The garment offers natural healing, cooling and anti-bacterial properties due to the method of fabrication. The garment also enhances wound healing and the well-being of the wearer.

The garment is optionally elastic free on the under band and so avoids excessive tightness and irritation. The provision of a front opening via the first adjustment means ensures ease of movement of the wearer when fitting the garment. Alternatively, the provision of a back opening via the first adjustment means ensures ease of use and familiarity to the wearer.

Preferably, the inner and/or outer layer of the garment have a material composition comprising at least 20% to 95% bamboo fibre, that is at least 20% and up to 25% to 30% to 35% to 40% to 45% to 50% to 55% to 60% to 65% to 70% to 75% to 80% to 85% to 90% or to 95% bamboo fibre.

Preferably, the inner and/or outer layer of the garment have a material composition comprising at least 70% bamboo fibre.

Preferably, the inner and/or outer layer of the garment have a material composition comprising at least 75% bamboo fibre.

Preferably, the inner and/or outer layer of the garment have a material composition comprising at least 80% bamboo fibre.

Preferably, the inner and/or outer layer of the garment have a material composition comprising at least 85% bamboo fibre.

Preferably, the inner and/or outer layer of the garment have a material composition comprising at least 90% bamboo fibre.

Preferably, the inner and/or outer layer of the garment have a material composition comprising at least 95% bamboo fibre.

Preferably, the inner and/or outer layer of the garment have a material composition comprising between 70% to 95% bamboo fibre, that is, 70% and up to 75% to 80% to 85% to 90% or to 95% bamboo fibre.

Preferably, the inner and/or outer layer of the garment have a material composition comprising between 70% to 80% bamboo fibre. That is 70% and up to 75% to 80% bamboo fibre.

Preferably, the inner and/or outer layer of the garment have a material composition comprising between 80% to 90% bamboo fibre. That is 80% and up to 85% to 90% bamboo fibre.

Preferably, the inner and/or outer layer of the garment have a material composition comprising between 90% to 95% bamboo fibre. That is 90%, 91%, 92%, 93%, 94% or 95% bamboo fibre.

Preferably, the inner and/or outer layer of the garment is made from bamboo fibre.

Preferably, the bamboo fibre is organic bamboo fibre, such as, Oek-Otex® certified bamboo material.

In one embodiment, the inner layer and/or outer layer of the garment have a material composition comprising 80% bamboo fibre, 12% nylon, 6% spandex and 2% polyester.

In an alternative embodiment, the inner and/or outer layer of the garment have a material composition comprising 95% bamboo fibre and 5% elastane.

Preferably, the inner and outer layers have the same material composition.

A further embodiment of the invention provides a post-surgery or a post breast cancer treatment brassiere garment, as described above, for use in improving the well-being of a wearer following breast surgery and/or breast cancer treatment.

A further embodiment of the invention provides a post-surgery or a post breast cancer treatment brassiere garment, as described above, for use in accelerating the wound-healing process of a wearer following breast surgery and/or breast cancer treatment.

In one embodiment, the wound is a surgical scar, skin irritation, radiotherapy skin lesions and other wounds typically associated with cancer surgery and/or treatments such as burns, blistering, itching, sweating, open sores, weeping sores and lymphedema, wound dehiscence, hematomas, infection, seromas, fungating lesions, and tissue necrosis.

In one embodiment, the wearer has received breast cancer treatment selected from radiotherapy, chemotherapy, hormone therapy, or a combination thereof.

In one embodiment, the wearer has undergone a breast surgery procedure selected from a mastectomy, lumpectomy, augmentation and/or breast reduction surgery.

In the specification, the term "post-surgery" should be understood to mean an individual who has undergone breast surgery, such a mastectomy, lumpectomy, augmentation and/or breast reduction surgery, and "breast cancer treatment" should be understood to mean treatment for breast cancer such as radiotherapy, chemotherapy, hormone therapy, or a combination thereof.

BRIEF DESCRIPTION OF THE DRAWINGS

The invention will be more clearly understood from the following description of some embodiments thereof, given by way of example only, with reference to the accompanying drawings, in which.

DETAILED DESCRIPTION

Materials and Methods

Figure 1:
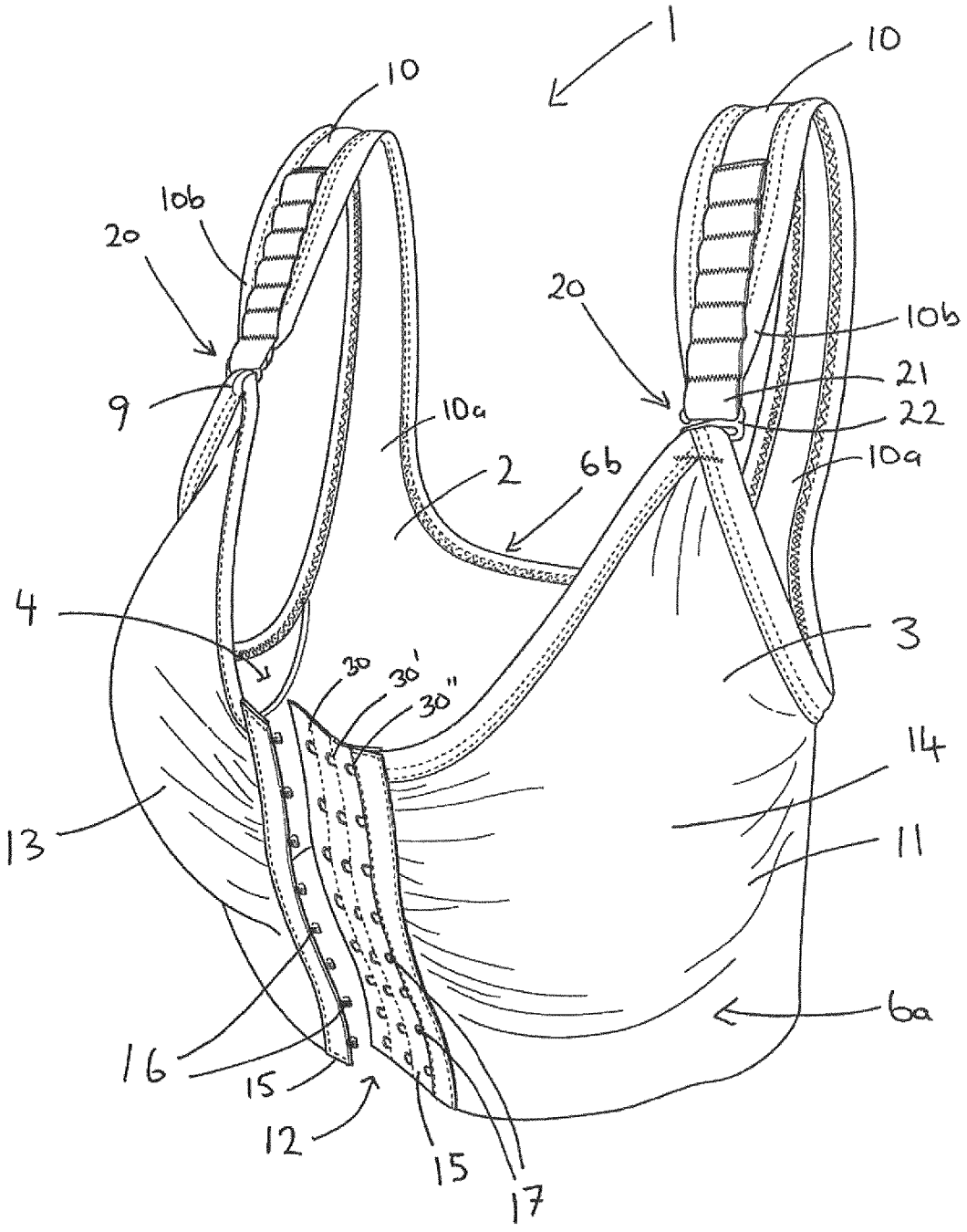
FIG. 1 is a perspective view of a post-surgery brassiere garment according to the invention.
Figure 2:
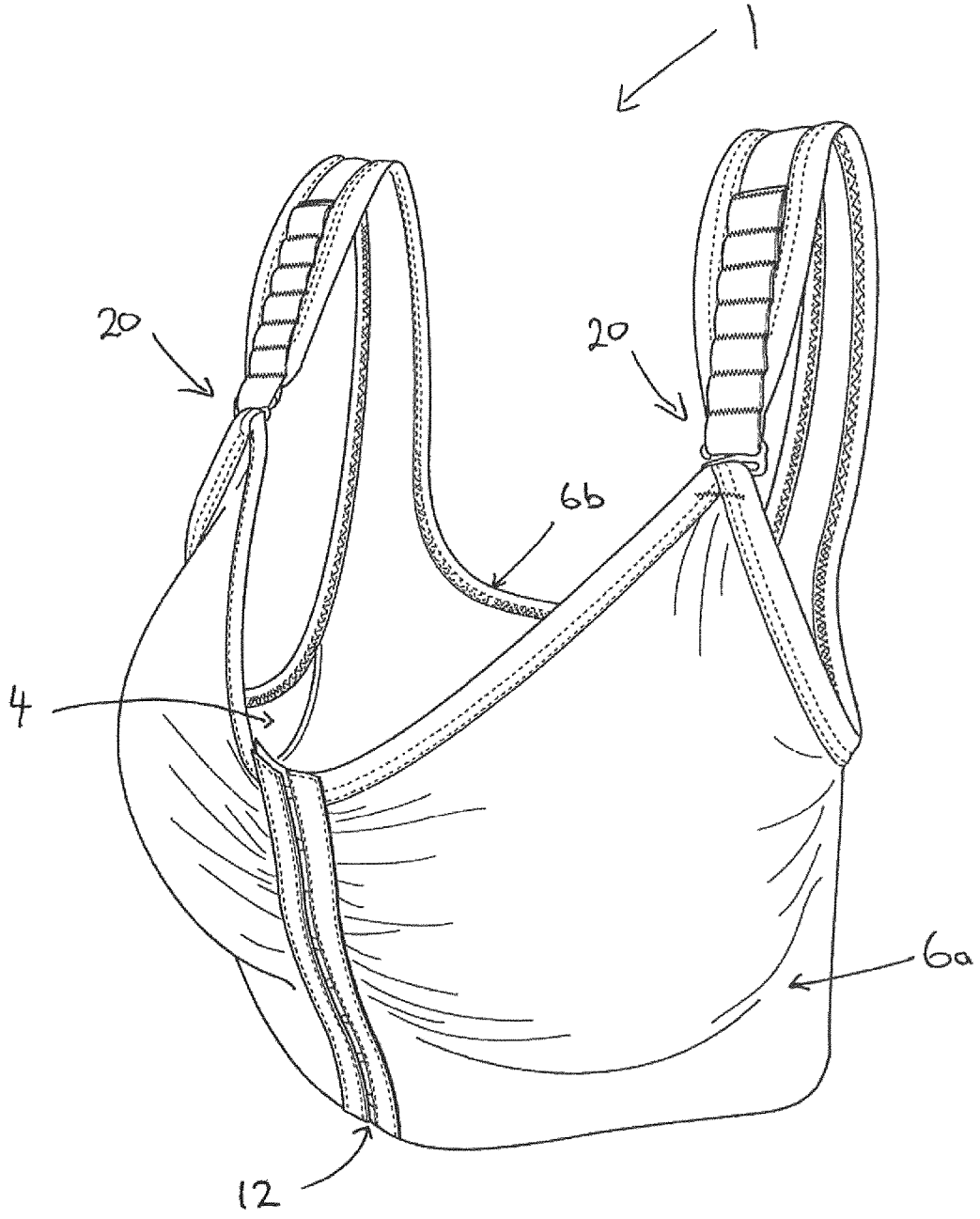
FIG. 2 is a perspective view of a post-surgery brassiere garment shown in FIG. 1 in a closed configuration.
Figure 3:
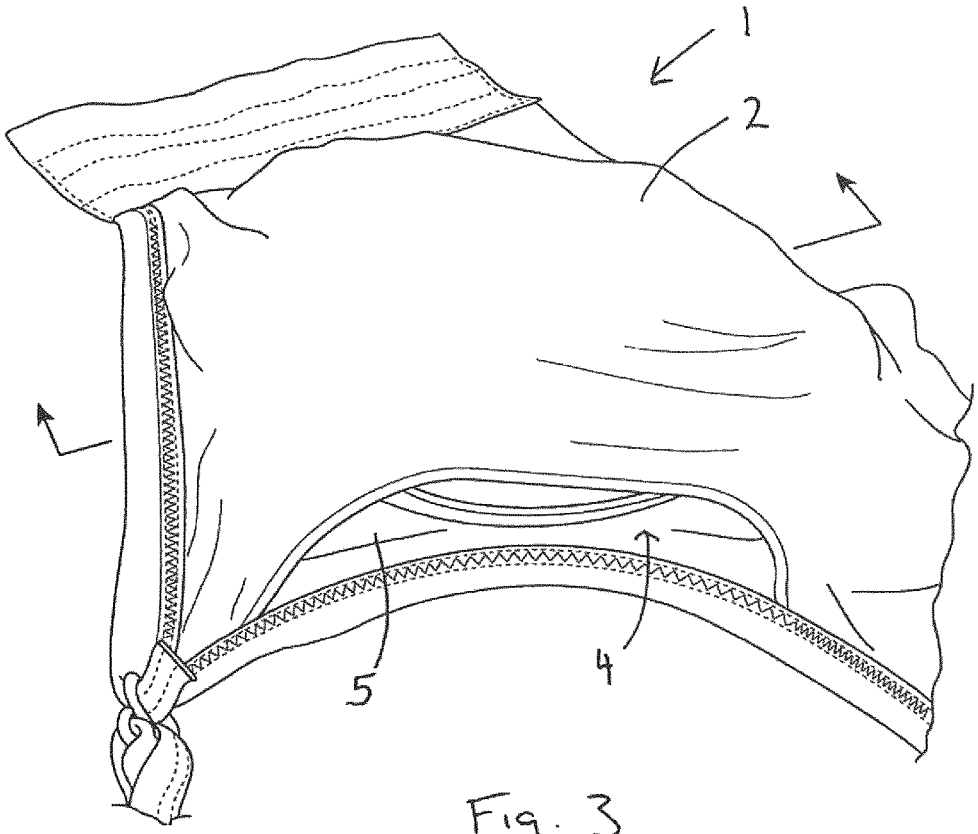
FIG. 3 is a perspective view of a portion of the post-surgery brassiere garment showing the inner layer and receiving pocket.
Figure 4:
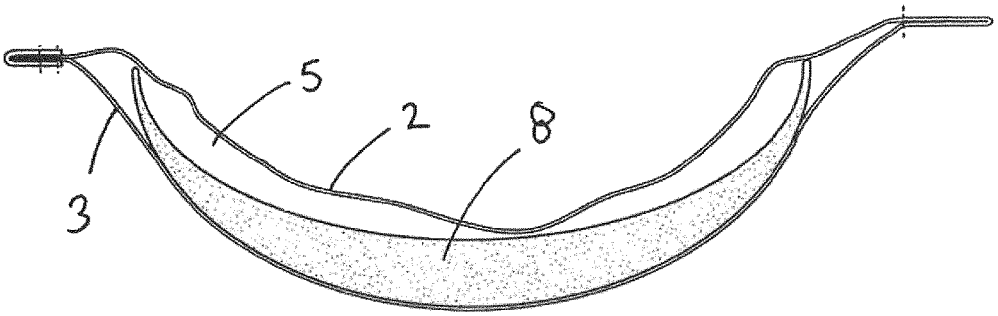
FIG. 4 is a sectional view of a portion of the post-surgery brassiere garment showing the receiving pocket.
Figure 5:
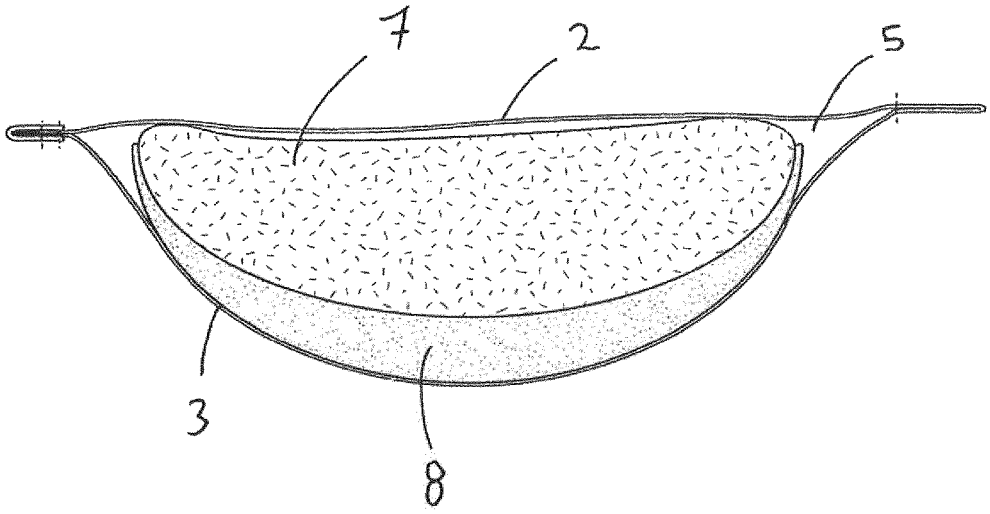
FIG. 5 is a sectional view of a portion of the post-surgery brassiere garment showing the receiving pocket and prosthesis insert.

A study to measure and explore a patient's experiences of the post-surgical or post-treatment garment in comparison to the current standard of care.

The study takes place in four acute Dublin Academic Teaching Hospitals; The Beacon Hospital, St. James's Hospital, St. Vincent's Hospital and the Mater Misericordiae University Hospital. With two of these, St. Vincent's and Mater Misericordiae being specific Breast Cancer Centres of Excellence with the National Breast Cancer Screening Clinic, BreastCheck on site.

49% of females diagnosed with breast cancer are between 45-64 years and 37% of over 65 years diagnosed, while 14% of those diagnosed were under 45 years old (NCRI, 2012). For this study, the sample size of 100 patients, having undergone breast surgery (either mastectomy or lumpectomy), will be split into 3 age groups, with number allocations based on the above recent statistics;

8 participants in each arm aged 18-44 years, 24 participants in each arm aged 44-64 years, and 18 participants in each arm aged 65 years plus.

Total: 50 per group.

Patient Inclusion Criteria:

1. Female over the age of 18 years, with no maximum age limit once all other criteria are met.

2. Have a comprehensive understanding and fluency of the English language with the ability to provide informed consent.

3. Be scheduled to undergo a mastectomy or lumpectomy for a new first time diagnosis of breast cancer within a 3 month period of recruitment—as this cohort are the principal users of post-surgery bras.

4. No pre-existing severe co-morbidities and/or documented psychological diagnosis i.e. depression, severe chronic disease—as we do not want to over-burden a person who has any ailments other than their surgery discomfort. As well as that, the bra is designed to help recovery from breast surgery, and having further ailments may alter data we receive.

5. Be available for the full duration of the study which will be 3 months from recruitment to post-assessment.

Patient Exclusion Criteria:

1. Are under the age of 18 years.

2. Do not have intellectual capacity to provide informed consent.

3. Are not scheduled to undergo a mastectomy or lumpectomy within a 3 month period of recruitment.

4. Have pre-existing severe co-morbidity or morbidities and/or documented psychological diagnosis, as the diagnosis of breast cancer is challenging enough and it may exacerbate any psychological condition, and the researcher would like to avoid any perceived additional stress for them.

5. Those that are not fluent English speakers, grossly hearing or speech impaired.

Data will be collected by a) three questionnaires and b) a qualitative data collection.

a) Primarily, the comparative trial design of the study will collect data by the quantitative method of questionnaires. After providing informed consent, the participants will be met day one post-operatively. Day one post-operatively, or post breast cancer treatment, the researcher will ask the consented participant to complete the pre-assessment survey consisting of the three questionnaires. They will be asked to complete the pre-assessment survey of the three questionnaires. The three questionnaires have been previously published and validated, with permission sought for their use. The participant will then be either fitted with the post-surgery or post breast cancer treatment garment of the invention or not, dependent on the group randomly allocated by a sealed envelope. The researcher, having completed a specialist lingerie fitting course will fit those in the intervention group with the correct size bra, provide two post-surgery bras, train and explain the care of the bra. The researcher will ask the participant to wear the post-surgery bra for a period of four weeks post-surgery. After four weeks, the researcher will meet the participant who will complete the exact same three questionnaires assessing the intervention.

Participants will be administered three questionnaires, as stated

1) Body Image Scale: An internationally used, validated scale comprising of 10 questions that measure bodily satisfaction based on the well referenced nature of this scale amongst studies of breast cancer patients (Akaya et al., (2011) Impact of Body Image on Quality of Life and Mood in Mastectomized Patients and Amputees in Turkey. Asian Pacific Journal of Cancer Prevention (12):2669-2673; Helms et al., (2008) Body Image Issues in Women with Breast Cancer. Psychology, Health & Medicine 13(3): 313-325; Hopwood et al., (2001) 'A Body Image Scale For Use With Cancer Patients'. European Journal of Cancer 37.2: 189-197.).
2) The Breast-Q Questionnaire: An internationally-used validated questionnaire tailored specifically for women with breast cancer to measure the impact surgery has on the participant's perceptions of their appearance, pain, sexuality and emotional status (Pusic et al., (2009) 'Measuring Patient Outcomes In Breast Augmentation: Introducing The BREAST-Q© Augmentation Module'. Clinics in Plastic Surgery 36.1: 23-32).
3) Short Form 12 (SF-12); internationally used and widely referenced measure of quality of life and has been recently validated (Hodgkinson et al., (2007) Breast Cancer Survivor's supportive care needs 2-10 years after diagnosis. Support Care Cancer. 15: 515-523).

b) A qualitative method of data collection will also be used in this research through semi-structured interviews at the post-study assessments. Due to the risk of the researcher reaching data saturation, the researcher will complete interviews on a total of 30 participants; randomly taking 5 from each group. Following the four week period, when the participant is back for review in the outpatients department, ensuring no extra burden to the participants, the researcher will meet the participant and complete the post-study assessment. This consists of re-doing the above three mentioned questionnaires. In addition to this a semi-structured interview will be completed on 30 participants to get a greater understanding of their experience and impact of wearing the bra on the psychosocial and quality of life of the patient, which may not be captured in questionnaires.

In addition to this, specific demographic information such as; age, height, weight, marital status, education level and employment status will be documented. Procedural details, including any complications and pain relief administered post-operatively will be reviewed and collected from the patient's medical records. The researcher deems this data necessary to collect to understand fully any other factors/variables that may differ between the patients' experiences in the post-operative recovery stage.

Example 1

This pilot study follows the same criteria for the larger study described above, and involves a cohort of women (n=15) who have undergone lumpectomy surgery (also known as wide local excision) and/or radiation therapy for newly diagnosed breast cancer in the Beacon Clinic and St. James' University Hospital, Dublin. The average age of a participant was 59 yr. old with a range of 34-90 yr. old. Recruitment was divided between the two hospitals; one group represented those participants who, at the time of the study, were post-lumpectomy surgery with no radiation therapy n=10; while the remainder represented those, who at the time of the study, had underwent a lumpectomy plus radiation therapy n=5. The results of this pilot study are expected to indicate the results of the study described above with the larger cohort of woman.

The study adopted a mixed methods approach—this entailed both quantitative (questionnaires) and qualitative (semi-structured interviews) tools (as describe above). Each participant received the same type of post-surgery garment and wore it for a 4 week period. Participants were informed about the study at their pre-operative appointment in their dedicated clinic. If they were interested in participating, they received an information sheet and consent form and were asked to bring the signed consent form with them to the pre-study assessment the morning after their surgery—participants were given a minimum of 24 hours to review the forms.

The lingerie fitting specialist then:

- fitted each participant with the correct sized post-surgery garment;
- taught participants how to wear the garment;
- provided participants with two post-surgery garments (one to wear while one is being washed). The garments were two different styles; one was front fastening ideal for the immediate post-surgery period and the other back fastening; and
- asked participants to wear the post-surgery garment for 4 weeks post-surgery.

Participants returned for their post-study assessment 4 weeks after their pre-assessment appointment. Participants were administered questionnaires relating to:

- Body Image Scale
- European Quality of Life Survey (EQ 5D 3L)
- Willingness-to-Pay questionnaire.

The BIS assesses body image and body image changes after cancer treatment and related interventions. Respondents are asked to answer questions with reference to the past week. The scale consists of ten items including affective items (e.g., feeling "self-conscious," "less feminine/masculine," "less physically attractive"), cognitive items (e.g., dissatisfied "with appearance," "with scar") and behavioural items (e.g., "avoid people," "difficult to look at yourself naked"). Response options range from "not at all" (score 0), "a little" (score 1), "quite a bit" (score 2) to "very much" (score 3). Question 10 ("dissatisfied with scar") has an additional response option "not applicable." Summing up the scores, a total score ranging from 0 to 30 per patient is obtained with 0 representing no distress or symptoms, whereas increasing scores represent increasing distress and symptoms.

The EQ-5D is a standardised measure of health status developed by the EuroQol Group in order to provide a simple, generic measure of health for clinical or economic appraisal. The EQ-5D 3 level version was introduced in 1990. This version essentially consists of 2 pages—the EQ-5D descriptive system and the EQ visual analogue scale. The EQ-5D-3L descriptive system comprises the following 5 dimensions: mobility, self-care, usual activities, pain/discomfort and anxiety/depression. Each dimension has 3 levels; no problems, some problems, and extreme problems. The EQ VAS records the respondent's self-rated health on a vertical, visual analogue scale where the endpoints are labelled 'Best imaginable health state' and 'Worst imaginable health state'. This information is used to provide a quantitative measure of health outcome as judged by the individual respondents. This questionnaire was administered pre- and post-study to measure the presence of changes in quality of life for the participants.

A researcher conducted a post-assessment semi-structured interview with 5 participants. The aim of this interview was to unearth the experience of using and living with the post-surgery bra or post-breast cancer treatment garment which offered an opportunity to collect everyday insights that were not captured in questionnaires. Interviews were no longer than 30 minutes.

Antibacterial Testing of Garment

With Reference To 2006 American Association Of Textile Chemists And Colorists, Technical Manual, AATCC Test Method 100-2012 "Antibacterial Finishes on Textile Materials: Assessment of", the samples were tested as follows:

- The samples were sterilised in the autoclave (121° C., 15 min) prior to the test.
- Neutralizing Solution: Phosphate Buffer Solution.
- Contact Time: 18-24 Hours
- Incubation Temperature: 37±2° C.
- Incubation Period: 24 Hours
- Agar Medium: Nutrient Agar.
- Test Culture: Staphylococcus Aureus (ATCC 6538)
- No. of Test Specimen: 4 Piece/Circular/@ 4.8 cm in diameter with 1.0±0.1 ml inoculum per trial.

Referring to the drawings, there is shown a post-surgery or post-breast cancer treatment brassiere garment, indicated generally by the reference numeral 1, for a wearer. Such a wearer will typically, though not exclusively, be a person who has undergone breast surgery, such a mastectomy, lumpectomy, augmentation and/or breast reduction surgery, and also treatment for breast cancer such as radiotherapy, chemotherapy, hormone therapy, or a combination thereof.

The garment 1 comprises an inner layer 2 and an outer layer 3. In the embodiment shown in FIGS. 1 to 7, the inner layer 2 and outer layer 3 are formed as a single piece of material having a material composition comprising 80% bamboo fibre, 12% nylon, 6% spandex and 2% polyester. A Santoni™ machine, which is a seamless knitting machine known in the art, may be used to make the garment 1 shown in FIGS. 1 to 7, which it will be understood is a seamless garment 1. In the embodiment shown in FIGS. 1 to 7, the inner layer 2 and the outer layer 3 are thus integrally or seamlessly connected such that the brassiere garment 1 is unitary.

Figure 8:
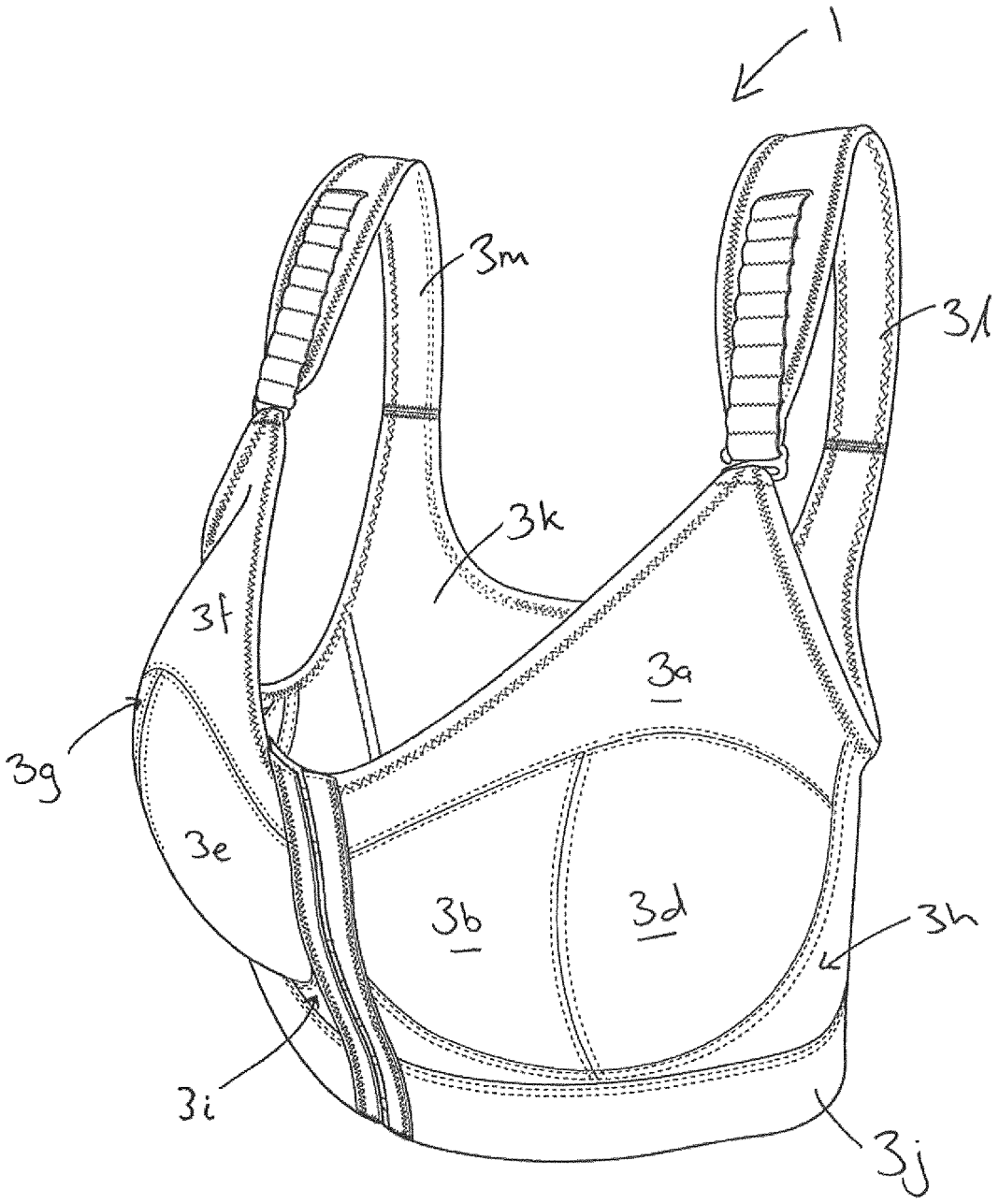
FIGS. 8 and 9 are perspective views of a post-surgery brassiere garment according to an alternative embodiment of the invention.
Figure 9:
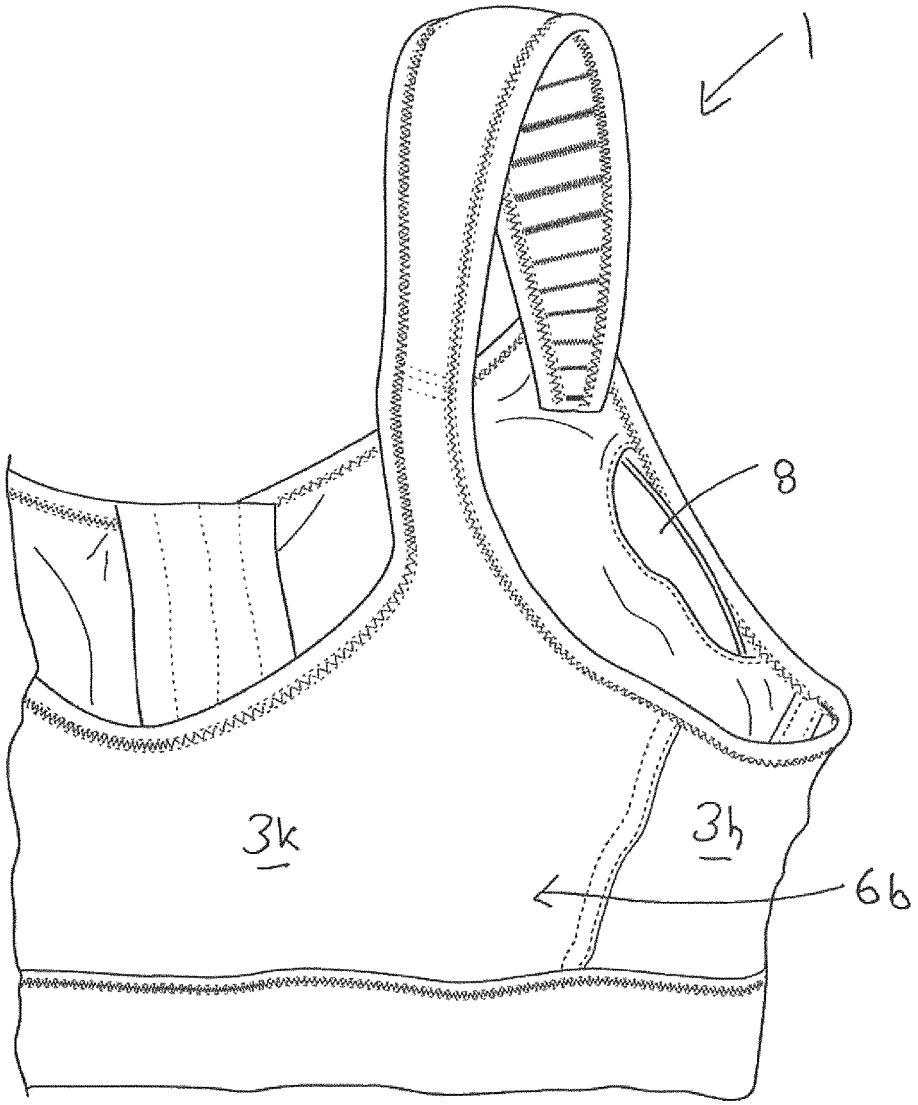

In an alternative embodiment, the inner layer 2 and/or the outer layer 3 may be constructed from a plurality of separate panels of material, for example, panels 3*a* to 3*m*, as shown, in FIGS. 8 and 9. Although it will be understood that the number and configuration of panels may be connected as required or as desired. In the embodiment shown in FIGS. 8 and 9, the inner layer 2 and outer layer 3 have a material composition comprising 95% bamboo fibre and 5% elastane.

The garment 1 further comprises heat seal printed care labels. One or both of the inner layer 2 and the outer layer 3 may also be attractively decorated so that the garment has a physical appearance resembling a lingerie article.

The garment 1 optionally comprises at least one opening, indicated generally by the reference numeral 4, formed between the inner layer 2 and outer layer 3 of material defining a receiving pocket 5 in a front region, indicated generally by the reference numeral 6a, of the garment 1 for insertion by the wearer of a prosthesis or filling material 7 simulating a breast of the wearer. Such a prosthesis material 7 may be a moulded plastic sponge or like material shaped and contoured to simulate a natural breast. The opening 4 may have a diameter of 6 cm to 8 cm to enable insertion of a prosthesis. In the instance shown, the opening is 7 cm, although it will be understood that the opening may be of any suitable size as required or as desired.

The garment 1 optionally comprises moulded contoured cups within the receiving pockets 5 in between the inner layer 2 and outer layer 3 for insertion of the prosthesis. The garment 1 further comprises removable pads 8, which may be made from soft foam or other suitable material. An edge trim which extends along at least of portion of the perimeter of the garment 1 and elastic required is housed within the edge trim to avoid irritation of a wearer by skin contact with the elasticated material.

Also shown is connection means comprising strap means 10 operable to secure the brassiere garment 1 over shoulders of a wearer and a band region 11 to enclose a portion of the torso of the wearer to secure the brassiere garment 1 to the wearer.

The garment 1 comprises first adjustment means 12 which is operable to adjustably close the front region 6*a* of the brassiere garment. A back region of the garment 1 is generally indicated by the reference numeral 6b. The front region 6*a* comprises left side panel 13 and right side panel 14 and the first adjustment means 12 comprises a first fastening device 15 to adjustably connect the left side panel 13 to the right side panel 14, which when connected close the band region 11 of the garment 1.

The first adjustment means 12 comprises a hook and eye arrangement in which there are provided a column of hook elements 16 on one of the left side panel 13 and right side panel 14, and spaced apart columns 30, 30', 30" of eye elements 17 on the other of the left side panel 13 and right side panel 14, the hooks 16 engaging with the eye elements 17 to close the front region 6*a* of the garment 1. The hook elements 16 and/or the eye elements 17 are optionally provided on flap members 15. As shown, connection of hook elements 16 with column 30" of the eye elements 17 will close the front region 6*a* of the garment 1 and provide the maximum level of post-surgery compression and support. To reduce compression as the wound region heals the wearer may select column 30 or 30' as required or as desired. It will be understood that although three columns 30, 30', 30" of eye elements 17 are shown it will be understood that any number of columns or arrangements of eye elements 17 may be provided according to the requirements of the wearer and nature of the surgery.

As shown, the first adjustment means 12 extends vertically from adjacent a top edge of the front region 6*a* to adjacent a bottom edge of the front region 6*a*. The first adjustment means 12 also connects the inner layer 2 and the outer layer 3 in the region of the receiving pockets 5 so as to close the pockets 5 on either or both the left side panel 13 and right side panel 14 of the front region 6*a*.

The garment 1 further comprises second adjustment means 20 which is operable to adjustably and releasably connect the strap means 10 to a front region edge 9 of the brassiere garment 1. The strap means 10 comprises a first end, indicated generally by the reference numeral 10*a*, which connects to the back region 6*b* of the garment, and a second free end 10*b* adapted to be connectable via the second adjustment means 20 to the front region edge 9 of the garment 1.

The straps 10 may optionally comprise padding for cushioning the wearers shoulders for improved comfort. The straps means 10 may also be wider than straps of a conventional brasserie. For example, the straps may have a width of the order of between 3 cm to 4 cm, and may taper inwardly toward the second free end 10*b*. In the instance shown in FIGS. 1 to 7 the straps are about 3.2 cm, although it will be understood that the The second free end 10*b* of the strap 10 mounts one of: a receiver 21 and a connector 22 of the second adjustment means 20, and the front region 6*a* mounts the other of: the receiver 21 and the connector 22 of the second fastening device 20. The receiver 21 and connector 22 may thus be located on either of the second free end 10*b* of the strap means 10 and the front region edge 9 of the garment 1.

As shown, the receiver 21 of the second fastening means 20 comprises a plurality of loop formations 21 each providing a hole or gap through which the connector 22 may be threaded.

A wearer when fitting the garment 1 thus selects one of the loop formations 21 on each strap 10 to couple with a connector 22 to secure the shoulder straps 10 to the front region 6*a*. The loops 21 extend in a sequence arrangement along the strap means 10 and are optionally formed by a layer of material or tape 23 connected by stitching at intervals to the outer layer 3 of the garment 1.

Figures 6A, 6B:
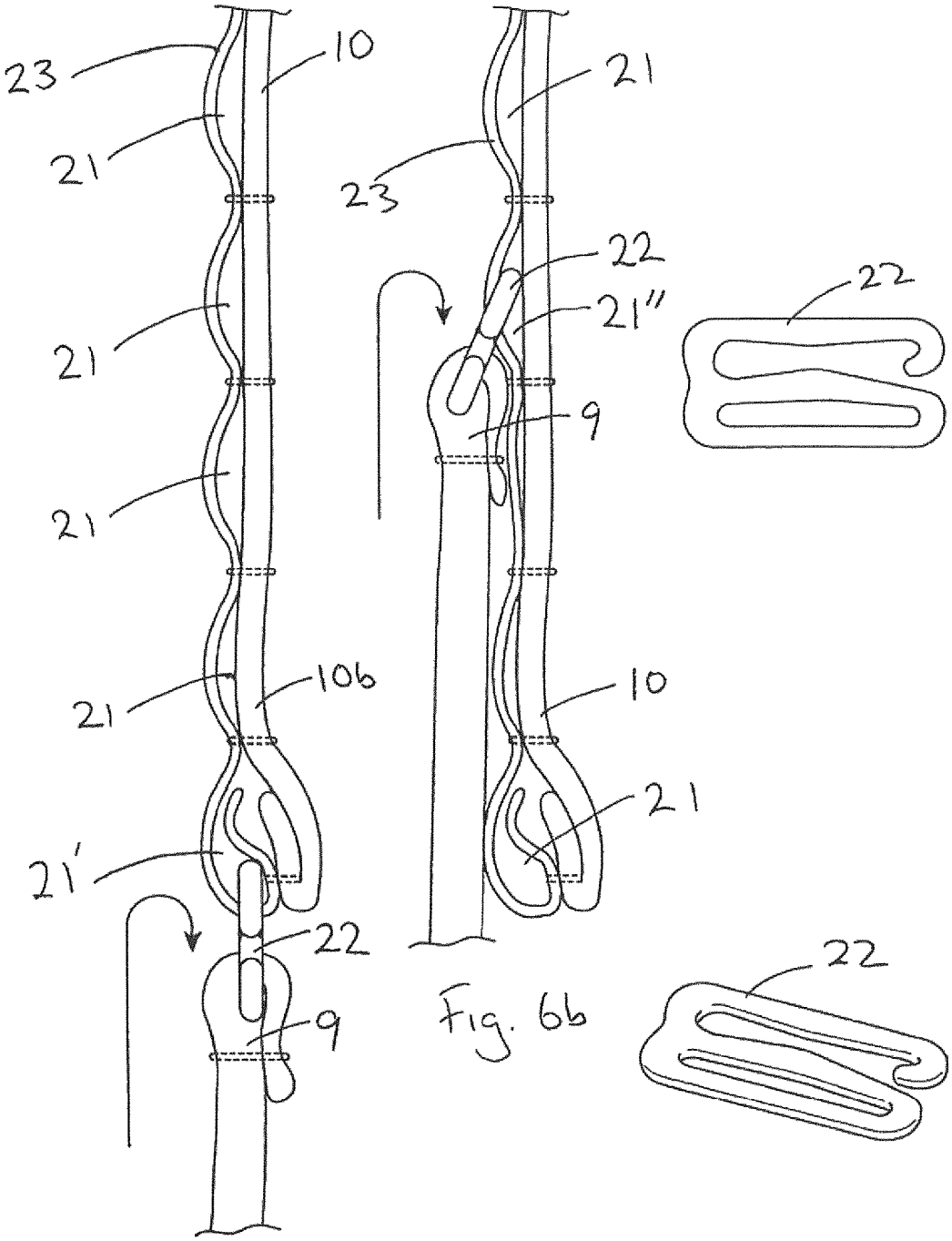
FIGS. 6*a* and 6*b* are sectional views showing an adjustment means of the post-surgery brassiere garment.
Figure 7A:
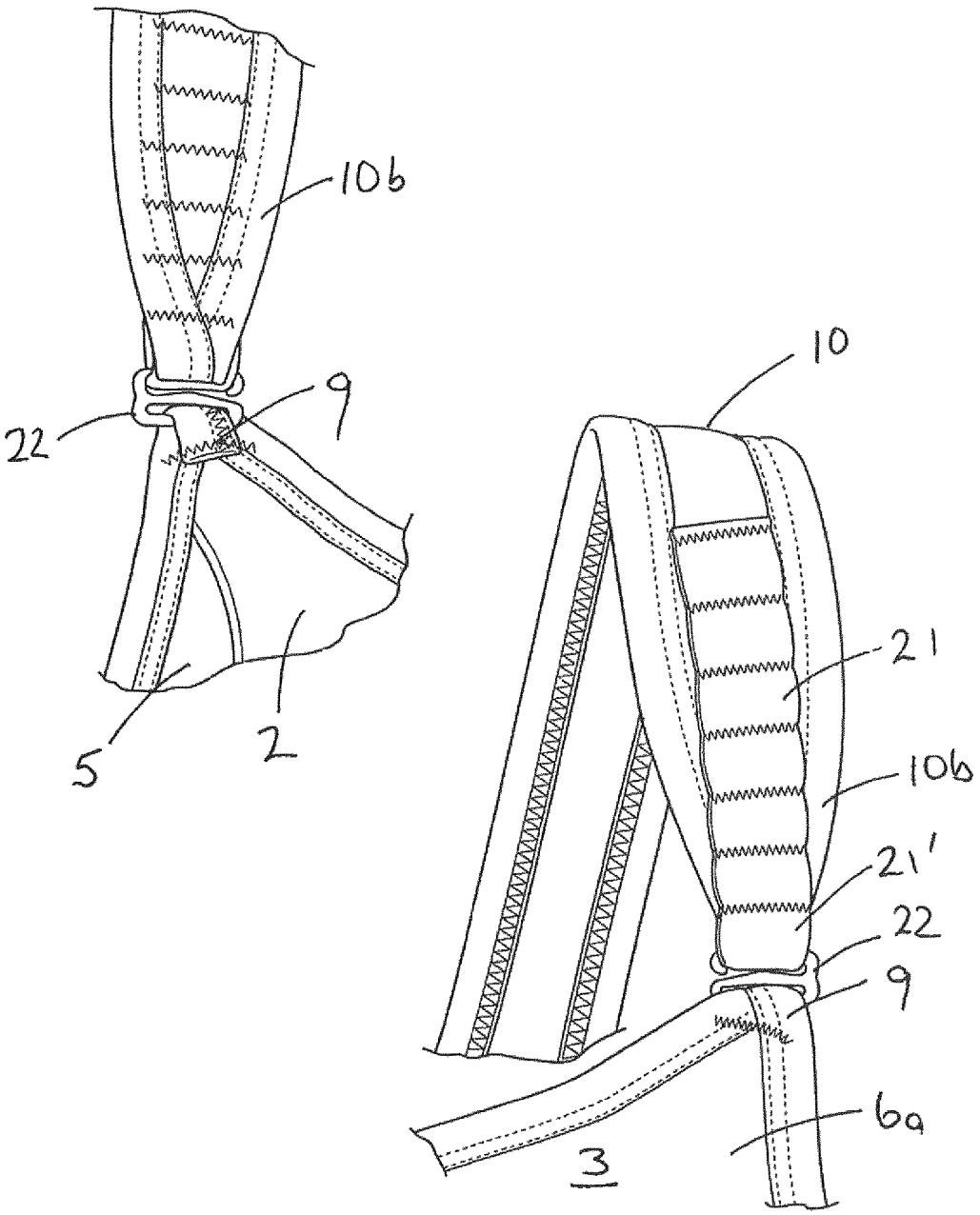
FIGS. 7*a* and 7*b* are sectional views showing an adjustment means of the post-surgery brassiere garment.
Figure 7B:
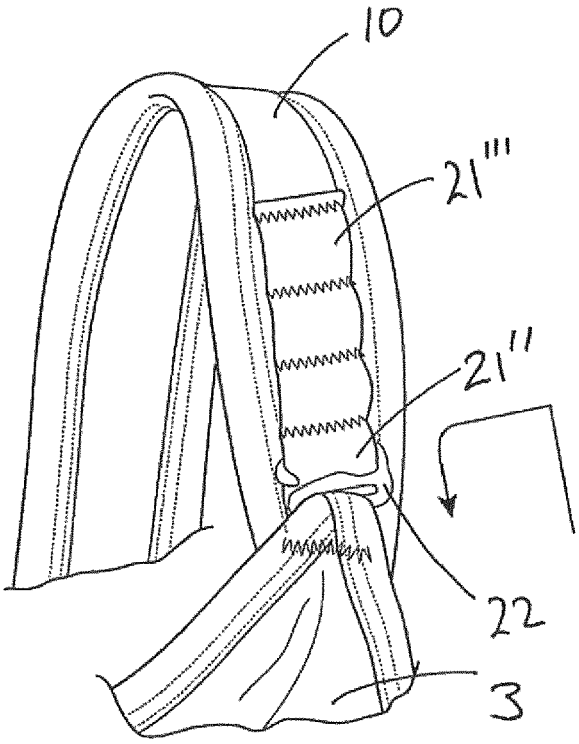
Figure 7B:
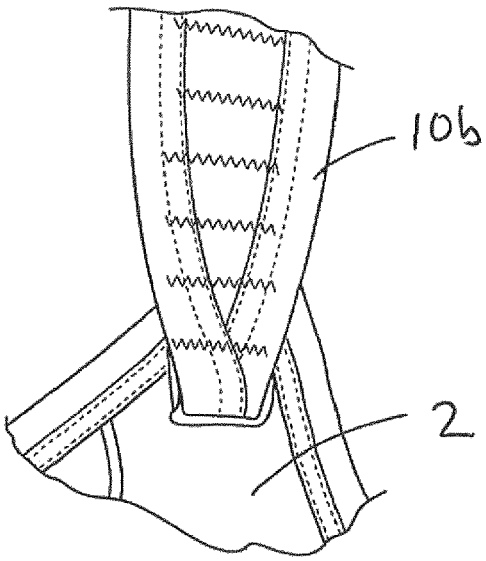

As shown, the connector 22 of the second fastening means 20 is formed as a hook operable to connect with each loop 21. In use, as shown in FIGS. 6*a* and 7*a*, the connector 22 is threaded through the loop 21' to provide a minimal level of post-surgery support and compression from the wearer's shoulders to the wound region. To increase the vertical lift of the garment relative to the torso and apply an increase in compression and support the wearer may select an alternative loop 21 which is located nearer to the end 10*a* of the strap 10, which in the instance shown in FIGS. 6*b* and 7*b*, is loop 21". For maximum over shoulder compression a wearer would thus select and connect hook 22 with loop formation 21'". It will be understood that although seven loop formations 21 are shown it will be understood that any number of may be provided according to the requirements of the wearer and nature of the surgery.

The use of the first adjustment means 12 and the second adjustment means 20 are thus together operable to enable the application of a desired, and importantly, an wearer adjustable level of compression to the wound region both from the wearer's shoulders and from the chest area simultaneously to thereby provide support to the wound region and reduce post-surgery swelling.

By selecting an appropriate loop formation 21 of the second adjustment means 20 and threading the connector 22 through the desired loop 21 the vertical lift of the garment relative to the torso of the wearer and associated compression and support from the wearers shoulders may be selected, and by selection and connection of the first adjustment means at the front of the garment 1 the horizontal shift of the garment 1 relative to the torso of the wearer may be adjusted to increase or decrease the associated compression and support across the wearer's chest.

Accordingly, as swelling starts to reduce a wearer may utilise the first and second adjustment means as required to avoid the previous requirement to purchase additional post-surgery garments as the healing process progresses. The dual adjustment means also ensures that the garment may be worn by wearers of different sizes and to fit to different body types.

The provision of such first and second adjustment means further ensures that the receiving pocket or pockets 5 of the garment 1, when present, and thereby the inserted prosthesis or filling material 7, may be correctly positioned, aligned and adjusted relative to the chest of the wearer by the wearer to simulate the appearance of natural breasts.

The garment 1 is optionally seamless to avoid irritating scars after surgery. The garment offers natural healing, cooling and anti-bacterial properties due the method of fabrication. The garment 1 is optionally elastic free on the under band and so avoids excessive tightness and irritation. The provision of front opening via the first adjustment means ensures ease of movement of the wearer when fitting the garment.

Results of Pilot Study

All 15 participants in the initial study were administered with and completed the BIS questionnaire before and after the intervention. The mean score attained for participants before intervention was 9.5 while the mean score attained at trial completion was 4.5. This result indicates that at the time of trial commencement, the sample group was experiencing a moderate level of distress with their body image and that at trial completion they were experiencing a very low level of distress with their body image. The qualitative data would suggest that the garment of the claimed invention had a positive impact upon participant's body image perception and therefore, it is a fair assumption that the post-surgery brassiere garment of the claimed invention was a contributing factor to the lower levels of body image distress reported at the end of the trial.

A lumpectomy (wide local excision) involves the removal of the breast tumour (the "lump") and some of the normal tissue that surrounds it. In many cases, one or more lymph nodes will be removed to help with diagnosis and to decide what treatment will be recommended. In approximately 25% of cases, the nerves in the surrounding tissues are injured during breast surgery. This may result in persistent burning or shooting pain in the area of the surgical wound and/or the underarm area on the affected side. Pain after surgery is usually treated with mild pain relievers.

For those who receive radiation therapy for breast cancer, they may experience some skin irritation. The treated breast can feel rough to the touch, red (like sunburn), and a little swollen. In some instances the skin may peel much like sunburn and become tender and sensitive (called a moist reaction) as a result. This is most common in the skin folds and the underside of the breast. Furthermore, radiation therapy can also cause shooting pains due to nerve damage. The discomfort caused by wound pain was a significant talking point for participants. However, participants reported that due to the comfortable nature of the garment, they benefitted from increased feelings of relaxation and well-being, with an additional psychological benefit in terms of pain reduction. Participants spoke very highly about the fabric of the garment of the claimed invention. Every participant commented on its softness, and how good it felt against their skin.

In both instances, the pain caused by the participants' wounds acted as a reminder of their surgery, crowding out head space for them to concentrate on other daily activities. However, due to the comfortable material from which the garment of the present invention is made from, the women experienced lessened levels of wound pain which granted them more time to concentrate on more everyday matters instead of constantly thinking about their surgery. This is an example of the invisible scars of breast cancer—though the wound is a physical phenomenon the impact it has on the psychosocial well-being of the participants due to pain is not something tangible for other's to see; it is yet another stress that the individual has to cope with internally. From their accounts, the use of the garment of the present invention resulted in the ability of the participants to cope with the pain and discomfort of their wound by offering increased levels of physical and thus, psychological comfort.

Studies have shown that prior to surgery for breast cancer, the occurrence of sleep disturbance ranges from 33% to 88%. In addition, during adjuvant chemotherapy and radiation therapy, reports of sleep disturbance range from 65% to 66%, respectively. The use of the garment of the present invention also improved the sleep of the participants.

Figure 10:
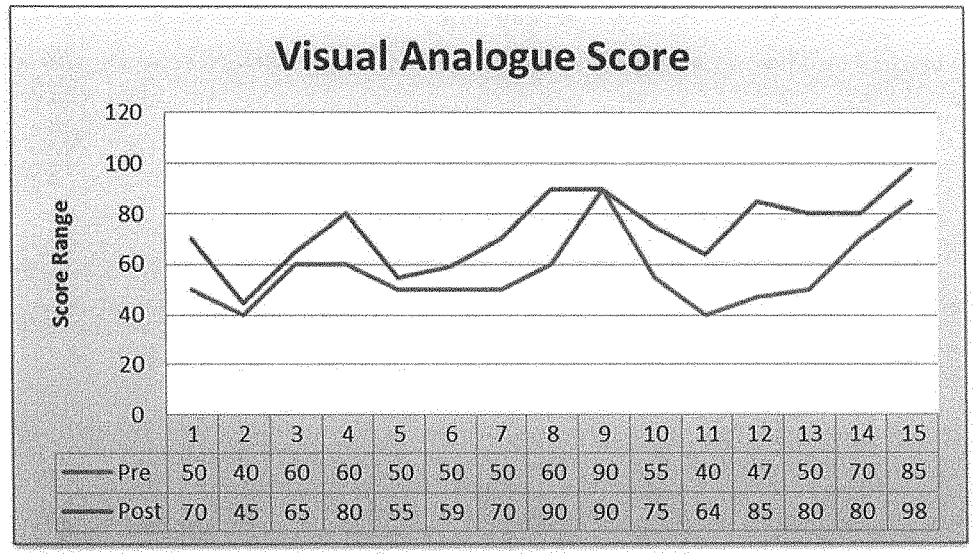
FIG. 10 is a graph illustrating the EQ-5D-3L results from a pilot study comparing the pre-study score and post-study score, where the post-study score is a result of the subject wearing the post-surgery brassiere garment of the invention; n=15. On the scale, 100 represents the "Best imaginable health status' and 0 represents the 'Worst imaginable health status'.

The results of the EQ-5D-3L are presented in terms of the Visual Analogue Score which represents the respondent's self-rated health status pre- and post-study (5 week period)—FIG. 10 represents findings. The average pre-study score reported was 49.8 while the average post-study score reported was 73.7. On the scale, 100 represents the "Best imaginable health status' and 0 represents the 'Worst imaginable health status'; the findings suggest that, post-study, the group perceived their health status to relate more to the 'Best' node on the spectrum than the 'Worst' node.

In terms of the willingness to pay, 87% of the participants were willing to pay to continue using the garment of the present invention, while 100% of participants responded that they would buy the garment once their wounds had healed. This illustrates that the participants were more than satisfied with the comfort and effect the garment had on their post-surgical wounds and post-treatment well-being.

It is predicted that the larger cohort study will also produce similar or improved results.

Antibacterial Aspects of the Invention

The results of the anti-bacterial properties of the garment of the invention is clearly illustrated in Table 1.

TABLE 1

Results indicating the anti-bacterial properties of the garment described herein.

| *S. aureus* ATCC 432 | [Bacteria] (cfu/ml) | 0 Hour (cfu/ml) | 24 Hour (cfu/ml) | % Reduction |
|---|---|---|---|---|
| Sample of Garment | $1.4 \times 10^5$ | $3.6 \times 10^4$ | $2.0 \times 10^2$ | 99.8 |
| Control | $1.4 \times 10^5$ | $1.3 \times 10^5$ | $3.4 \times 10^5$ | 0.0 |

The number of *S. aureus* colony forming units from the garment after a 24 hour incubation period shows a more than significant reduction in the bacteria when compared to control. In fact, there was an increase in bacterial growth in the control sample, which is a typical cotton material or cotton/polyester mix used in a brassiere.

The results here have demonstrated that there is provided an improved post-surgery or post breast cancer treatment brassiere garment, which has the physical appearance of a lingerie article, and also improves or accelerates post-surgery or post breast cancer treatment wound-healing and elevates the well-being of the user.

Aspects of the present invention have been described by way of example only and it should be appreciate that additions and/or modifications may be made thereto without departing from the scope thereof.

The invention claimed is:

1. A post-surgery or a post breast cancer treatment brassiere garment for a wearer comprising:

a connection means comprising strap means operable to secure the brassiere garment over shoulders of the wearer, and a band region to enclose a portion of a torso of the wearer to secure the brassiere garment to the wearer;

a first adjustment means operable to adjustably close the band region of the brassiere garment, and a second adjustment means operable to adjustably connect the strap means to a front region of the band region of the brassiere garment, whereby, the first and second adjustment means are together operable to adjustably compress the torso of the wearer in region of the wearers chest, wherein the garment comprises an inner layer and an outer layer, and the inner and outer layers of the garment have a material composition comprising between 70% to 95% bamboo fiber, and wherein the garment is used to accelerate wound-healing post-surgery or a post breast cancer treatment.

2. The garment according to claim 1, wherein the inner layer and the outer layer are connected such that the brassiere garment is unitary.

3. The garment according to claim 2, wherein the inner layer and the outer layer are seamlessly connected.

4. The garment according to claim 1, wherein the inner layer and/or the outer layer comprise a plurality of panels connected together to form the garment.

5. The garment according to claim 1, wherein the garment comprises an edge trim which extends along at least a of portion of a perimeter of the garment.

6. The garment according to claim 5, wherein an elastic is housed within the edge trim to avoid irritation of a wearer by skin contacting with the elastic.

7. The garment according to claim 1, wherein at least one opening is formed between the inner and outer layer defining a receiving pocket in a front region of the garment for a prosthesis or filling material simulating a breast of the wearer.

8. The garment according to claim 7, wherein the first and second adjustment means are together further operable to enable a wearer to adjust a position of a receiving pocket relative to a chest of the wearer when the brassiere garment is worn.

9. The garment according to claim 7, wherein the first adjustment means is provided adjacent the or each receiving pocket of the garment.

10. The garment according to claim 1, wherein the first adjustment means extends vertically from a top edge to a bottom edge of the front region or a back region.

11. The garment according to claim 1, wherein the front region comprises left and right side panels and the first adjustment means comprises a first fastening device operable to adjustably connect the left side panel to the right side panel, which when connected closes the band region of the garment.

12. The garment according to claim 1, wherein the back region comprises left and right side panels and the first adjustment means comprises a first fastening device operable to adjustably connect the left side panel to the right side panel, which when connected closes the band region of the garment.

13. The garment according to claim 1, wherein the first fastening device comprises a hook and eye arrangement or a zipper arrangement, or a combination thereof.

14. The garment according to claim 1, wherein the second adjustment means comprises a second fastening device to releasably connect the strap means to the front region of the brassiere garment.

15. The garment according to claim 1, the second adjustment means connects the strap means to the front region of the garment adjacent to a position of a receiving pocket of the garment.

16. The garment according to claim 1, wherein the strap means comprises a first end connected to a back region of the garment, and a second free end adapted to be connectable to a front region of the garment.

17. The garment according to claim 16, wherein the second free end mounts one of: a receiver and a connector of the second fastening device, and the front region mounts an other of: the receiver and the connector of the second fastening device, whereby the receiver and connector are engaged to adjustably connect the strap means to the front region of the brassiere garment.

18. The garment according to claim 17, wherein, the receiver of the second fastening means comprises a plurality of adjacent loop formations.

19. The garment according to claim 18, wherein the loop formations extend from a position intermediate the first end and second free end of the strap means in a sequence towards to the second free end.

20. The garment according to claim 16, wherein the loops are formed by a strip of material or tape connected to the outer layer.

21. The garment according to claim 16, wherein the loops are formed by a strip of material or tape connected to the outer layer along a face of the free end of the strap means or the front region of the garment or the back region of the garment.

22. The garment according to claim 20, wherein the strip of material or tape is connected to the outer layer of the garment by connections such that gaps formed in between the connections provide adjacent loop formations for coupling with the connector.

23. The garment according to claim 1, wherein the second fastening means comprises a hook operable to connect with a loop or a zipper arrangement.

24. The garment according to claim 1, further comprising molded cups within each receiving pocket on the or in between the first and second layers for insertion of a prosthesis.

25. A method for accelerating wound healing process following breast surgery or breast cancer treatment, said method comprising wearing a post-surgery or a post breast cancer treatment brassiere garment of claim 1 following breast surgery or breast cancer treatment, thereby accelerating wound healing process.

* * * * *